US006910560B2

(12) United States Patent
Dulin

(10) Patent No.: US 6,910,560 B2
(45) Date of Patent: Jun. 28, 2005

(54) DUAL ACCESS LUGGAGE WITH ORTHOGONAL ISOLATION PACKING STOWAGE-CELL SYSTEM

(76) Inventor: Jacques M. Dulin, 698 Oak View Pl., Sequim, WA (US) 98382-3159

( * ) Notice: Subject to any disclaimer, the term of this patent is extended or adjusted under 35 U.S.C. 154(b) by 0 days.

(21) Appl. No.: 10/439,668

(22) Filed: May 16, 2003

(65) Prior Publication Data

US 2004/0003975 A1 Jan. 8, 2004

Related U.S. Application Data

(60) Provisional application No. 60/385,054, filed on May 29, 2002.

(51) Int. Cl.[7] ..... A45C 5/12; A45C 5/14

(52) U.S. Cl. ..... 190/109; 190/110; 190/111; 190/112; 190/113; 190/115; 190/903; 150/112; 150/113; 206/293; 383/38

(58) Field of Search ..... 220/504, 507; 150/113, 112; 190/110–112, 114, 119, 903, 36, 109; 383/38, 40; 206/293

(56) References Cited

U.S. PATENT DOCUMENTS

| | | | | | |
|---|---|---|---|---|---|
| 782,047 | A | * | 2/1905 | Pearson | 190/112 |
| 818,248 | A | * | 4/1906 | Herrnecker | 190/12 R |
| 2,510,754 | A | | 6/1950 | Norlin | |
| 2,571,892 | A | * | 10/1951 | Kath | 206/315.9 |
| 2,574,089 | A | * | 11/1951 | Cochran | 190/125 |
| 2,657,726 | A | | 11/1953 | Silverman | |
| 2,874,813 | A | * | 2/1959 | Bunte | 190/109 |
| 4,260,004 | A | * | 4/1981 | Domke | 206/316.2 |
| 4,273,223 | A | * | 6/1981 | Tomlinson | 206/292 |
| 4,472,870 | A | * | 9/1984 | Kotkins, Jr. | 29/445 |
| 4,506,769 | A | | 3/1985 | Franco | |
| 4,527,677 | A | * | 7/1985 | March et al. | 190/110 |
| 4,542,826 | A | * | 9/1985 | Adams | 206/427 |
| 4,641,751 | A | * | 2/1987 | Walker | 206/478 |
| 4,790,434 | A | * | 12/1988 | Schoberg et al. | 206/387.14 |
| 4,793,508 | A | * | 12/1988 | Thompson | 220/533 |
| 5,054,589 | A | | 10/1991 | Bomes et al. | |
| 5,108,119 | A | | 4/1992 | Huang | |
| 5,178,246 | A | * | 1/1993 | Kramer | 190/109 |
| 5,255,781 | A | | 10/1993 | Dulyea, Sr. | |
| 5,294,145 | A | * | 3/1994 | Cheng | 280/654 |
| 5,435,423 | A | | 7/1995 | Rekuc | |
| 5,474,204 | A | * | 12/1995 | Sutyla | 220/507 |
| 5,791,481 | A | * | 8/1998 | Thomas | 206/581 |
| 5,950,779 | A | * | 9/1999 | Miyoshi | 190/18 A |
| 6,000,509 | A | | 12/1999 | Chisholm | |
| 6,065,574 | A | | 5/2000 | Miyoshi | |
| 6,070,888 | A | * | 6/2000 | Wang | 280/37 |
| 6,179,102 | B1 | | 1/2001 | Weber et al. | |
| 6,223,870 | B1 | | 5/2001 | Godshaw | |
| 6,640,944 | B2 | * | 11/2003 | Adams | 190/110 |
| 2002/0032950 | A1 | | 3/2002 | Kuo | |

FOREIGN PATENT DOCUMENTS

| | | | | |
|---|---|---|---|---|
| DE | 3841362 A1 | * | 6/1990 | A45C/5/12 |
| EP | 0428451 A1 | * | 5/1991 | 150/113 |
| WO | WO9321793 | * | 11/1993 | |

* cited by examiner

*Primary Examiner*—Sue A. Weaver
(74) *Attorney, Agent, or Firm*—Innovation Law Group, Ltd.

(57) ABSTRACT

Dual access hand luggage having in the interior a stowage cell system or assembly, preferably made of stretch fabric, that permits isolation packing and orthogonal stowage and retrieval of goods retained in the cells by access from either face of the suitcase. For roll-on type travel bags, a pop-up handle is provided in a side wall, rather than on the back face as in current luggage. The inventive system is particularly useful for suitcases, carry-on or roll-on bags, back packs, totes, brief cases, and laptop cases. Dual-sided external access combined with internal, modular, fixed-size or variable-size stowage cells, oriented generally orthogonal to the planes of both sides, permits packing and selective removal of articles through either face of the bag so that articles otherwise buried in the bag are easily removed by flipping the bag over and accessing the item through the openable back face.

19 Claims, 5 Drawing Sheets

DUAL ACCESS LUGGAGE WITH ORTHOGONAL ISOLATION PACKING STOWAGE-CELL SYSTEM

RELATED CASE

This application is the Regular U.S. patent application of Provisional Application No. 60/385,054 entitled Orthogonal Luggage System filed by the same inventor on May 29, 2002, the priority of which is hereby claimed under 35 USC §119.

FIELD

The invention relates to hand luggage, and more particularly to suitcases, travel bags of the carry-on or roll-on type, back packs, totes and specialty bags such as brief cases, computer and laptop carry cases, camping bags, military duffle bags, medical bags, and the like, having dual-sided external access combined with internal, modular, fixed-size or variable-size stowage cells, oriented orthogonal (transverse) to the plane of one or more faces or sides, for orthogonal packing and selective removal of articles (isolation packing) such as clothing, gear, supplies, equipment, personal grooming and hygiene items, first-aid items, food and the like.

BACKGROUND

There are a wide variety of hand carried travel bags and specialty equipment bags, commonly grouped as personal luggage, that are commercially available. The types range from traditional clamshell, hard-sided suitcases, typically of graduated sizes, to overnight cases, to fabric type roll-on overnight bags. The latter have access to the interior from one face side that employs a heavy-duty zipper for closure. In all these luggage designs, there is "box" type access, by which is meant that the packaging system is through a single opening, and the packaging is typically "layered" in a "First-In, Last-Out" (or "Last-In, First-Out") sequence.

This FILO (or LIFO) packaging arrangement gives the rise to inevitable problems of access, primarily that to access the bottom layers, the top layers must be removed or disturbed. That is, a layer system of packing buries the prior packed item. In the case of clothing, accessing a given item of clothing by removal of the layers above it, followed by repacking is time consuming. The alternative of folding back or feeling around in the lower layers introduces wrinkles in clothing. In addition, layer packing involves placing worn or soiled clothing into contact with fresh clothing, the result being introduction of odors and possibly stains on the fresh clothing.

These problems arise regardless of whether the bag is a clam shell suitcase, a roll-on bag type, a top opening bag, a back pack, or the like. Accordingly, there is a need in the field for a new approach to luggage design that permits isolation packing for fast packing and access without disturbing other packed items, introducing contact of soiled with clean clothing or other items and prevention of migration of the stowed objects during travel, and which design is highly flexible and adaptable to a wide range of luggage forms or types.

THE INVENTION

Summary, Objects and Advantages

The invention is directed to a revolutionary approach to luggage design that combines the advantages of multi-side access to the interior from the exterior, and an internal, modular, fixed or variable-sized stowage cells system or assembly for isolation packing and retention of good. The cells are oriented generally orthogonal to the plane of at least one side or face, for receivingly engaging articles to be packed, such as clothing, gear, supplies, equipment, personal grooming and hygiene items, first-aid items, food and the like.

In a first embodiment, we will consider a carry-on or roll-on type travel bag by way of a non-limiting example. These travel bags have opposed planar faces, each face having perimeter zipper closures permitting access from two opposed sides. The two faces zipper perimeter preferably employs 2-way zippers having two separately slideable closure actuators. The perimeter zippers extend around a bit more than three adjacent marginal edges to permit the entire face to be folded back.

In the description herein, the travel bag sides or faces, denominated a front face and a back face, respectively, are considered generally parallel. The space between the spaced-apart faces is bounded by a perimeter wall that is generally rigid and made of a high impact polymeric material, such as an ABS, HDPE or other suitable polymer, that defines the thickness of the travel bag. The volume defined by the faces and perimeter wall comprises the packable interior packing volume for the load capacity of that particular type of luggage.

The travel bags are typically made of tough polymeric fiber or sheet goods, such as a hard-shell ABS, or flexible fabric of nylon, polypropylene, Kevlar, or other polymer, canvas, rug-weave fabric, leather and the like, herein generically referred to as "fabric". Where the travel bag is of the carry-on or roll-on type, the rigid perimeter wall is typically fabric-covered for aesthetic or design reasons. One or more of the perimeter walls typically include one or more handgrips, handles, loops, carry straps or carry strap connectors (such as D-Rings), and the like to facilitate handling and carrying.

In the exemplary embodiment of a generally rectangular roll-on type travel bag, the bag includes a telescopic pull-handle unit, typically having two telescoping tubes connected at their outer ends by a handlebar. The tubes may be round or square in cross-section, and may include a pop-up spring with a latch release and/or locking detents. Or the handle may be a T- or L-Type handle mounted on the upper end of a single, preferably square, support tube. The handle can also be secured in the retracted, stowed position by a hook and loop fastener, e.g., Velcro brand hook and loop fabric.

One or more of the faces can include one or more internal or external pockets, preferably external, that permit carrying objects and items such as books, papers, newspapers, magazines, writing implements, laptop computers, and the like in an orientation generally parallel to the plane of the face containing the pocket. External pockets do not ordinarily communicate with the interior volume of the travel bag. Typically, one lower pocket is about half to ⅔ the size of the face on which it is secured, and the upper pocket is half to ⅓ or less the size. Internal pockets may be mesh type or waterproofed for holding previously worn clothing articles or hygiene kits or articles.

The internal stowage cells may occupy from a part of the interior volume up to the entire volume, typically from 50% to 100% of the volume. In one embodiment, the cells are constructed from stretchable, thin but tough, fabric or webbing. The axes of the individual cells are oriented orthogonal to at least one face, typically transverse to both faces, in the example given above. An item to be stowed is inserted in and removable from a given cell without disturbing the adjacent cells or their contents. This permits isolation packing by insertion in the cells, rather than layering, which buries the earlier items packed.

By way of example, clothing is folded to a width approximately the depth of the cell, rolled up and inserted in a suitably sized cell so that it can be removed from either the front or back face, by selective opening the zipper of the closest side and simply pulling the individual article out without disturbing adjacent articles in their individual cells. Where the depth of the cell is greater than the rolled length of clothing inserted in that cell, a second item is placed in the same cell on top of the first, the first item can be accessed from the rear face of the travel bag, while the second is accessed from the front face.

Thus, the inventive luggage system by using orthogonally oriented stowage cells, provides expandable-to-fit compartments, for retaining and keeping separate the items to be stowed (isolation packing). The inventive stowage cell system prevents migration of articles during travel while permitting selective retrieval without disturbing adjacent and without the need for unpacking many layers above the given article.

BRIEF DESCRIPTION OF THE DRAWINGS

The invention is described in detail with reference to the drawings, in which.

DETAILED DESCRIPTION OF THE INVENTION, INCLUDING THE CURRENT BEST MODE

The invention is described in detail in a plurality of embodiments by way of example, and not by way of limitation, of the principles of the invention in its various aspects, features and functions of the several structures, components, sub-assemblies and the overall combination thereof. One skilled in the art will be able to ascertain that it is evident the invention admits of a wide range of equivalent structures and substantially equivalent functions. This description will clearly enable one skilled in the art to make and use the invention, and describes several embodiments, adaptations, variations, alternatives and uses of the invention, including what is presently believed to be the best modes of carrying out the invention.

In this regard, the invention is illustrated in the several figures, and is of sufficient complexity that the many parts, interrelationships, and sub-combinations thereof simply cannot be fully illustrated in a single patent-type drawing. For clarity and conciseness, several of the drawings show in schematic, or omit, parts that are not essential in that drawing to a description of a particular feature, aspect or principle of the invention being disclosed. Thus, the best mode embodiment of one feature may be shown in one drawing, and the best mode of another feature will be called out in another drawing.

All publications, patents and applications cited in this specification are herein incorporated by reference, as if each individual publication, patent or application had been expressly stated to be incorporated by reference.

Figure 1:
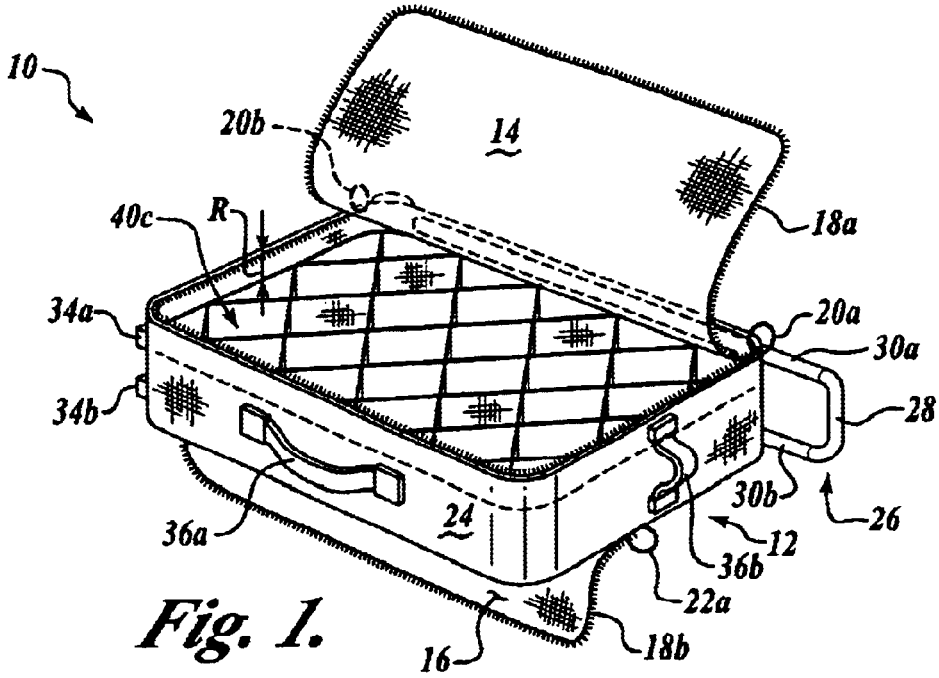
FIG. 1 is an isometric of an exemplary, first embodiment of the inventive orthogonal luggage system in which the orthogonal stowage cell assembly is shown adapted to a typical travel bag of the roll-on or carry-on type.

FIG. 1 shows a first embodiment of an exemplary piece of luggage 10 in accord with the principles of the invention characterized by dual face access and internal orthogonal stowage cells for transverse packing of clothing and other articles, which permits the selective removal of individual items without disturbing the adjacent articles. Travel bag 12 is, by way of example, a roll-on, carry-on or overnight type bag having a heavy fabric top face 14, a heavy fabric bottom face 16 and a rigid perimeter wall 24 to which a rolling transport handle assembly 26 is attached. The opposed, generally planar faces are spaced apart a distance D, best seen in FIG. 5, that defines the interior packable volume of the travel bag or suitcase 12. The marginal edge of each of the faces 14 and 16 are openably secured to the perimeter wall 24 by heavy-duty, luggage grade, two-way perimeter zippers, 18*a* for the top face 14 and 18*b* for the bottom face 16. Each zipper includes two separately sliding closure guides or actions and ring pulls, identified as 20*a* and 20*b* for the top zipper 18*a*, and 22*a*, 22*b* (not seen in FIG. 1) for the bottom zipper 18*b*. The separate actions permit selective positioning around the perimeter to permit selective access for packing or removal of individual items packed in the various cells.

The perimeter zipper typically will extend around at least three of the four marginal edges, plus enough more of the fourth edge to permit fully folding back of the particular face. This is evident in FIG. 3, where face 14 is fully folded back. Note that the cells can be considered to have row and column "addresses", as is particularly evident in FIGS. 4, 6A, 6B, 6D–6F and 8. The selective opening function permitted by the dual zipper guides on opposed faces permits isolation packing, that is, selective removal and insertion in a cell from a packed bag without disturbing articles in adjacent cells. Thus, the inventive cell system overcomes the aggravation of layered packing, in which the fiber adhesion and static cling of one article of clothing to another makes it almost impossible to remove one article in the midst of a plurality of layers of clothes. For example, the attempt to pull out, horizontally, a T-shirt, from the middle of the stack inevitably results in rumpling the remaining articles.

Figure 4:
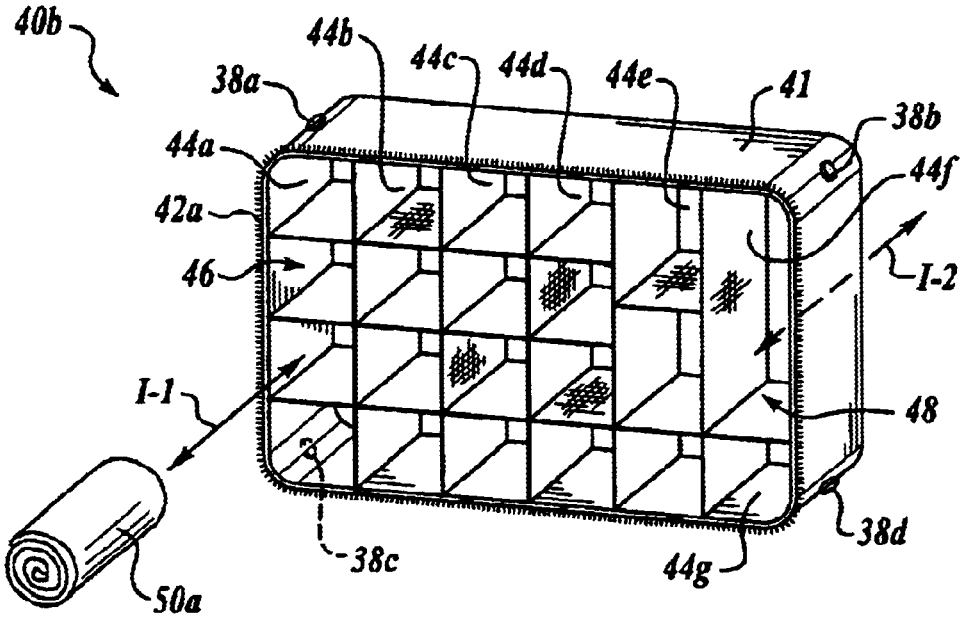
FIG. 4 is an isometric view of an orthogonal stowage cell assembly in its unfurled configuration as would fit into the shell of FIG. 3, and illustrating the feature of transverse insertion and removal of an article of clothing from the same or opposite side of the cell assembly.

In contrast, the inventive orthogonal luggage system permits selectively accessing the cell in which the T-shirt is inserted, and pulling it out without disturbing the adjacent clothes in their separate cells. Where some bulky clothes are layered on top of the cells, as in FIG. 5, the access to the T-shirt cell is by the bottom face. The travel bag is simply flipped over so face 16 is on top, the zipper 18*b* is selectively opened and the T-shirt pulled out the "backside". This is illustrated in FIG. 4, wherein the T-shirt 50*a* is inserted, arrow I-1, from the front, and removed from the back as shown by arrow I-2. The packing and unpacking of the inventive luggage system is thus bi-directional, rather than uni-directional in currently available luggage. The benefits of rapid, selective access without disturbing other packed articles are significant and self-evident.

Figure 2:
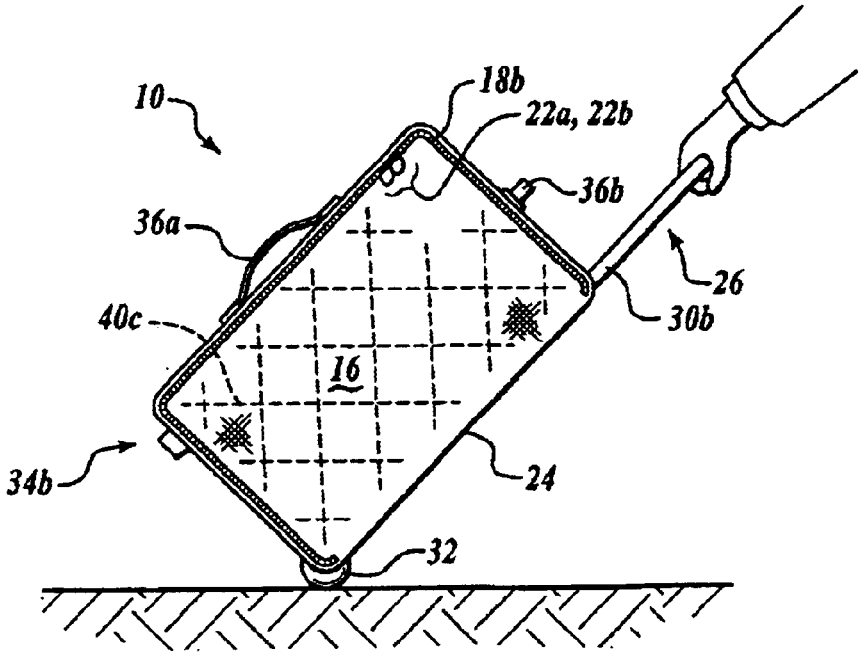
FIG. 2 is a side elevation view of the roll-on travel bag of FIG. 1 in the rolling orientation with the handle extended and grasped by the user.

FIG. 1 also illustrates additional alternative features that may be used in combination with the orthogonal cell system of the invention. A retractable, spring and detent release pop-up type handle assembly 26 is mounted on the back face of the perimeter wall, and comprises a pull handle 28 bridging a pair of support tubes 30*a* and 30*b*. The handle is shown, alternatively, in FIG. 1 as mounted external of the perimeter wall 24, and internal of the wall 24 in FIG. 2. In FIG. 2, a recess at the right-hand upper corner may be provided for the handle 28, and that corner also includes spaced holes through which the support tubes extend and retract.

As best seen in FIG. 2, the travel bag also preferably includes wheels 32 mounted on the corner opposite the handle 28 so that the bag can be tipped and rolled easily by the user. A pair of legs 34*a*, 34*b* are mounted on the same face of the perimeter wall as the wheels, preferably adjacent the opposed corner. The bag preferably includes one or more hand grips 36*a*, 36*b* strategically placed on adjacent faces of the perimeter wall to assist in handling, stacking, lifting up stairs and the like.

Figure 3:
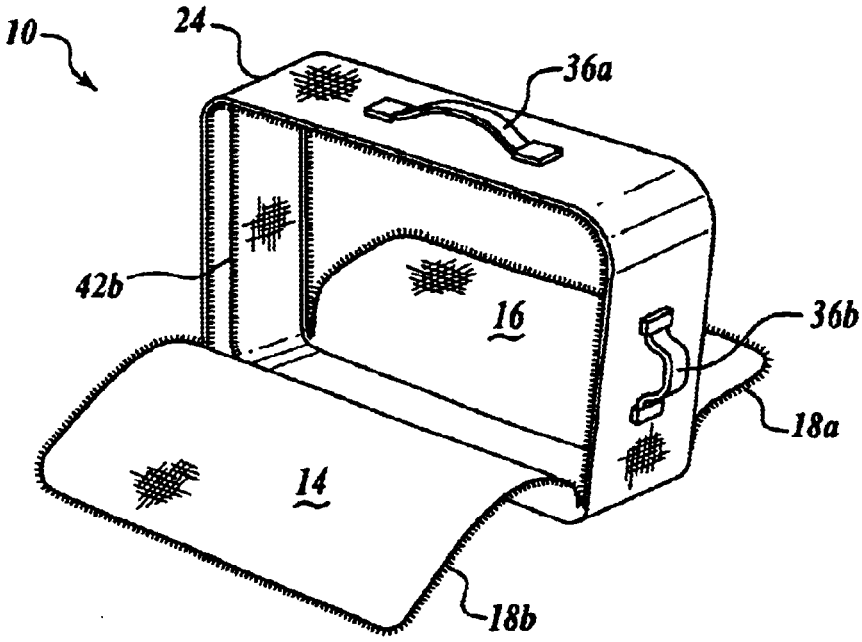
FIG. 3 is an isometric view of the travel bag shell (with the internal cell assembly removed) to illustrate the dual access feature via the opposed top and bottom face panels being openable by two-way perimeter zippers.
Figure 5:
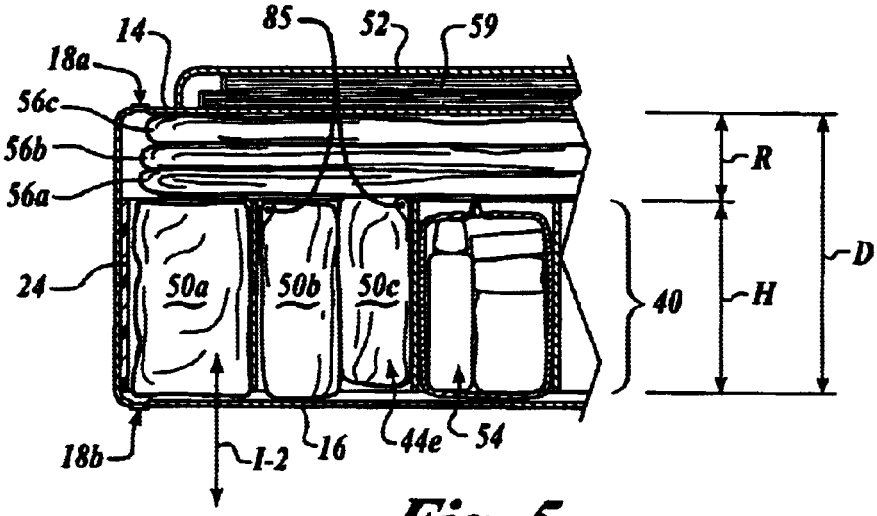
FIG. 5 is a partial section view through a packed travel bag of FIGS. 1–4 illustrating the orthogonal packing functionality of the towage cell assembly and the provision of a headspace above the cell assembly for layered packing of bulky or fine clothing.
Figure 9:
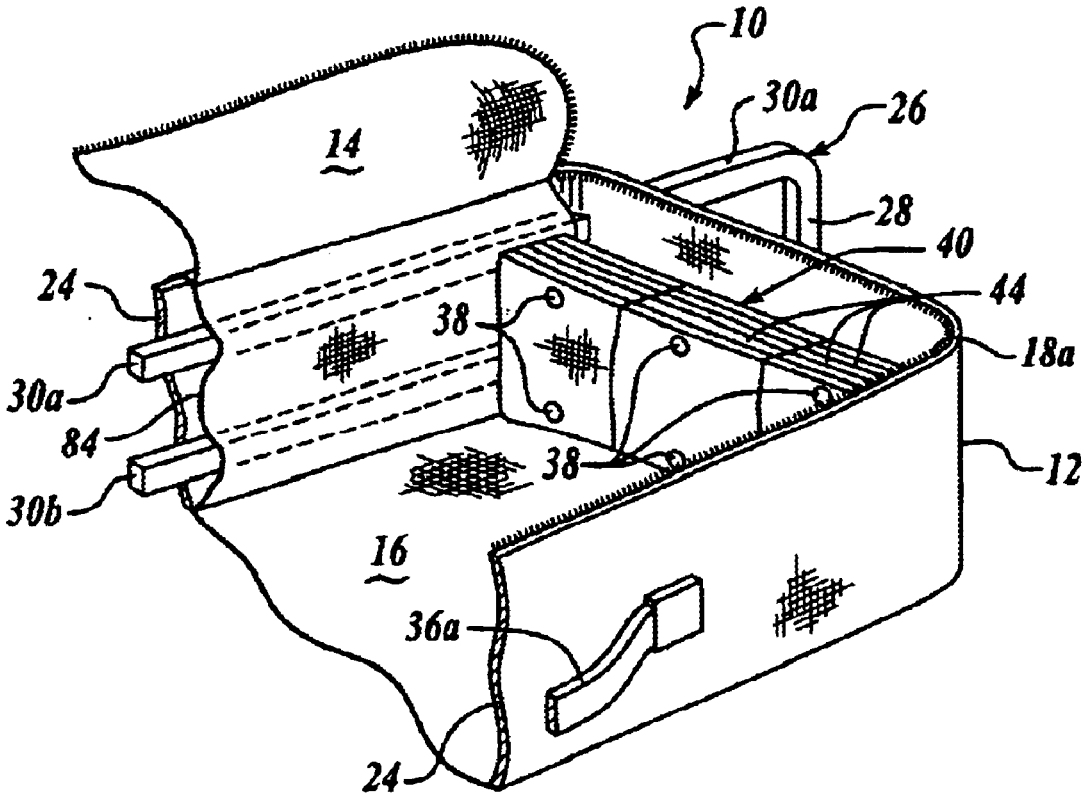
FIG. 9 is an isometric view of an exemplary travel bag with one end broken away showing an inventive stowage cell assembly collapsed (furled) against one end wall.

The stowage cell assembly 40 of FIG. 4 (shown as 40*b* in this figure) is mountable in the travel bag 12; the stowage cell assembly is shown in FIGS. 1 and 5 in the unfurled or fully extended position, and in FIG. 9 in a collapsed (furled) unused position. The assembly 40 can be permanently sewn or glued in place, or may be removable. As shown in FIG. 4, a top margin of the perimeter wall 41 of the cell assembly 40 may include a perimeter zipper 42*a* for securing the assembly in proper position to the interior face of the perimeter wall 24 of the travel bag shell. The mating zipper half 42*b* is best seen in FIG. 3. The placement of the internal zipper for the cell assembly can be selected to provide a head space, indicated by the arrow R in FIGS. 1 and 5 to receive a few bulky clothing articles in a layered packing arrangement. This headspace R is seen in isometric in FIG. 1 and in vertical section in FIG. 5. When articles are packed in the headspace, the articles in the cells can still be accessed and selectively removed or packed by unzipping the bottom face 16 and removing them directly, as shown by the arrow I-2 in FIG. 5.

Indeed, because of the use of stretch fabric for the cells, individual cells can be accessed and unpacked or packed with the suitcase standing up, that is, in the orientation of FIG. 2, including when the handle is vertical, while the bag rests on the wheels 32 and legs 34. The remaining articles will simply remain in place, being gripped by the elastic fabric of the cells. Thus, an additional feature of the inventive orthogonal system, in those embodiments employing elastic or stretchable fabric cells, is that not only are the articles selectively accessible without disturbing adjacent articles, but the packing/unpacking can be done in a wide variety of orientations of the bag. Imagine attempting to pull out of a conventional layer-packed bag a T-shirt from the bottom when the bag is in an upstanding orientation, without disturbing and messing up the adjacent layers.

FIG. 4 shows the orthogonal stowage cell assembly 40 (identified 40*b* in this figure) in an unfurled (extended) orientation as it is inserted in a piece of luggage such as the travel bag of FIG. 1. In this embodiment, a plurality of generally square and/or rectangular cells of different sizes are constructed of webbing or fabric sewn, glued, snap-fastened, hook and loop-fastened (e.g., Velcro brand hook and loop tape), or otherwise secured to a perimeter wall 41. The perimeter wall 41 may be stretch or non-stretch fabric, or may be a relatively wide band of thin, relatively rigid material, such as plastic, so the stretch fabric cell assembly can be manufactured separately and mounted in the shell of the travel bag shown in FIG. 3. In the embodiment where the elastic fabric cells are secured (sewn or glued to the interior face of the band 41, then the plastic of that cell assembly "insert" can be solvent glued, riveted, snap-fastened, RF bonded, zippered or sewn to the rigid perimeter wall 24 of the travel bag shell of FIG. 3. In an important alternative, the perimeter wall 41 of the cell insert may also be of fabric, but need not be stretchable, except where an expandable cell system is used, e.g., as in FIG. 6D and/or FIG. 9.

The internal walls of cells 44*a*–44*g* (not all the cells are numbered in FIG. 4 to prevent confusion) are preferably constructed of stretch fabric or elasticized fabric so that the cells can accommodate and grippingly retain a wide range of sizes of the articles inserted therein. Thus, a fewer number of different sized cells are needed. A suitable exemplary fabric is an 85% polyester-15% Nylon stretch fabric that is uni-axial, that is, stretches only in the longitudinal and/or lateral direction, but not in the vertical direction, such as a Special Occasion Basics fabric identified by SKU 190 584-4519. That is, the fabric from which the cells are constructed is oriented so that the stretch is parallel to the longitudinal and lateral axes of the suitcase, but not vertically (not in the direction of the arrow H in FIG. 5). The fabric can be biaxial or any color, such as black, to match the suitcase liner.

As shown in FIGS. 4 and 6, a range of stowage assembly cell sizes is preferred, and it is well within the skill in the art to provide different layouts of different sized cells for the most efficient packing of a particular class of goods or articles. Thus, a man's suitcase or travel bag can have a different arrangement and some larger sized cells than a woman's travel bag because of the different bulk of their respective clothing. For example, cell 44*f*, for shoes, may be as shown for a woman's bag, yet that cell could span and include the cell 44*g* just below it for men's suitcases, since men's shoes are larger than women's. The cells are preferably sized to securely grip most articles, but it should be clear that more than one article can be packed in a single larger cell. This is illustrated in FIG. 5, where articles 50*b* and 50*c* are packed in a single cell 44*e*. In premium or fancy luggage, the cells can be dedicated to certain articles and so labeled. Thus, the shoe cells may be located at what will be the bottom of the bag, in the roll-away position of FIG. 2; that is, cell 44*f* of FIG. 4 would be adjacent the wheels 32 and the legs 34 of the bag in FIG. 2.

FIG. 4 also shows provision for removal of the cell assembly, in that a top zipper 42 is provided for positive vertical location of the assembly in the shell of FIG. 3, and snaps 38*a*–38*d* are provided at the lower corners to engage receiving snaps in the bottom of the suitcase or bag (adjacent the juncture of perimeter wall 24 and the bottom face 16) as seen in FIGS. 1, 3 and 5. Additionally, FIG. 3 shows an embodiment of a travel bag without the rollers and pop-up handle. FIG. 9 shows a collapsible cell assembly.

The stretch fabric used for the cells may be any commercially available stretch fabric, which may range from about 10% to about 200% elongation, and preferably about 20% to about 100% elongation, but simple trials, not involving undue effort or experimentation, will reveal the most useful elongation range for a particular use. In addition, the principles of the invention include providing luggage shells with more than one mountable/removable cell assembly insert for the shell, each insert having different height, or numbers of cells, or configuration of cell shapes, partial cells, degree of fabric stretch, and the like so that the luggage is multipurpose, with the cell assemblies being quickly changed out to accommodate a different packing purpose for use of the luggage. The cell material may be water proofed, or provided with drawstrings 85 (in FIGS. 5 and 6*b*) on one or both outer faces of the cells in the eve with wet or soiled clothes or other liquids, such as cosmetics, sun lotions, after shave, perfume and the like.

FIG. 5 is a section view through a portion of an inventive travel bag showing several cells 40 packed with clothing, such as a T-shirt 50*a*, underwear 50*b* and 50*c* in a single cell 44*e*, and a hygiene kit or bag 54, such as a shaving kit. Top face 14 includes one or more external pockets 52, the one shown containing a magazine 59. The height H of the cells is preferably, but need not be, less than the depth D of the bag, the remainder R being a head-space for layer-packing of several articles of fine clothing, such as dress pants 56*a*, long-sleeve tie shirt 56*b* and a jacket 56*c*. The clothing and articles 50*a, b, c*, 54 may be inserted in the cells when the top 14 is opened, then the additional clothing layered on top. When it is desired to retrieve an article from the cells, such as a fresh T-shirt 50*a* and underwear 50*b*, the suitcase can be flipped over and the back face 16 un-zippered for orthogonal removal, as shown by arrow I-2. The head-space R can be any desired amount, including zero. Where there is no head height, that is the height of the stowage cell assembly is substantially the same as D in FIG. 5, it is still possible to pack clothes 56*a, b, c* (FIG. 5), if the cells are not filled to the full height, D, as the unfilled cell fabric portion simply folds over under the weight of the clothes 56, being stretchable.

Figure 6A:
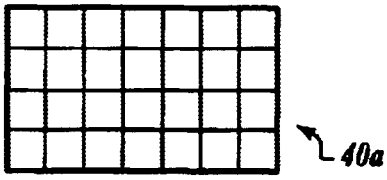
FIG. 6 illustrates a series of six examples, 6A–6F, of cell configurations for the orthogonal stowage cell assembly, ranging from same or variable size square, rectangular, diamond, triangular and hexagonal cells, with 6D additionally illustrating a selectively expandable cell assembly that can be adjusted to provide packing space for large objects such as shoes.
Figure 6D:
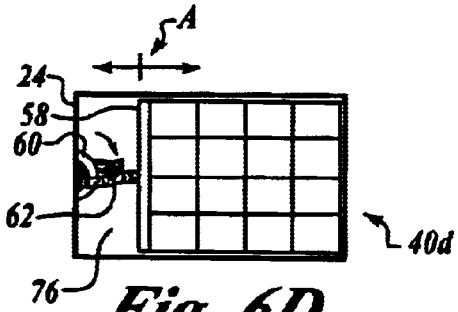
Figure 6B:
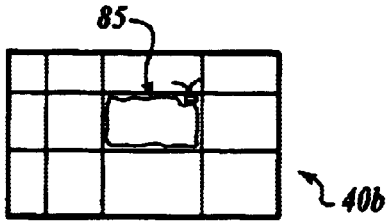
Figure 6E:
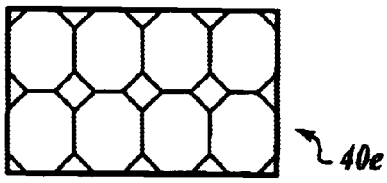
Figure 6C:
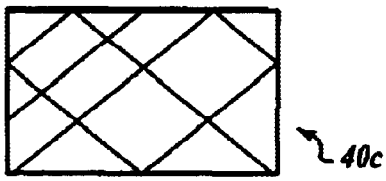
Figure 6F:
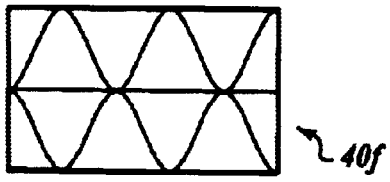

FIG. 6, in six exemplary sub-parts 6A through 6F shows in plan view cell assemblies 40*a* through 40*f* having several variations of cell shapes, sizes and layouts, including: generally square and slightly rectangular in FIG. 6A; predominantly rectangular in FIG. 6B; triangular, rectangular, square and irregularly shaped and oriented at an angle to the longitudinal and lateral axes of the bag in FIG. 6C; triangular, hexagonal and square in FIG. 6E; and triangular in FIG. 6F. The cell assembly of FIG. 6D also includes a draw bar 58 at one end permitting the stretchable cells to be extended (unfurled) or retracted, as shown by arrow A. A hook and loop strap (e.g., Velcro brand) is drawn through a D-ring 60 secured to one end of the perimeter wall interior face 24 to permit the longitudinal adjustment to whatever length is desired. The space 76 that is not occupied by the cell assembly may be used for bulky objects, such as shoes, hair dryers, etc. FIG. 6*b* shows a drawstring closure 85 for a cell.

Figure 7:
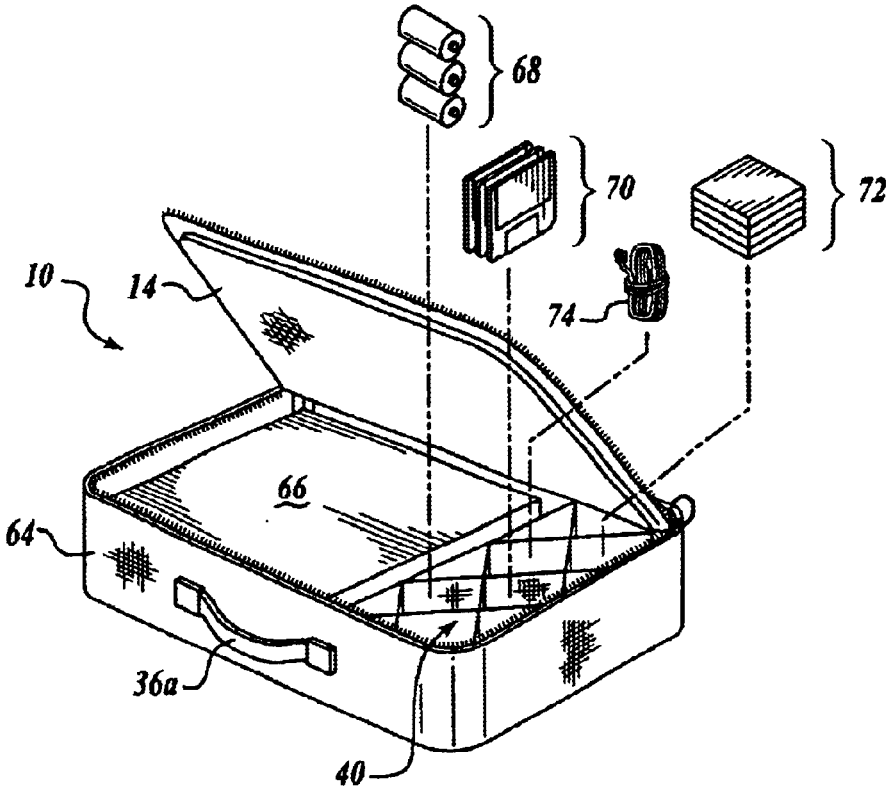
FIG. 7 is an isometric view of the inventive orthogonal cell packing system adapted to a laptop computer case or briefcase.
Figure 8:
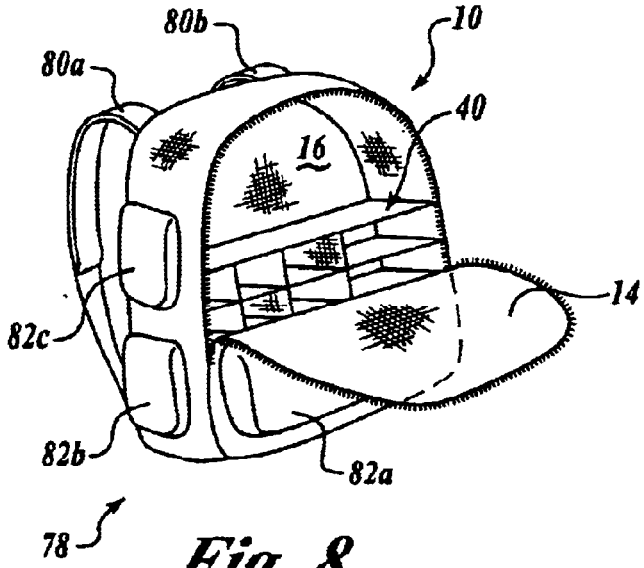
FIG. 8 is an isometric view of the inventive orthogonal cell packing system adapted to a backpack, daypack, rucksack, or other type of recreational or military carry pack.

FIG. 7 shows the inventive cell assembly 40 adapted to a case 64 for carrying a laptop computer 66. Individual cells are shown by way of example as securely holding batteries 68, floppies 70, self-stick note pads 72, phone or data cable 74 and the like. FIG. 8 shows the cell assembly 40 being adapted to a back pack, day pack, military rucksack or the like 78 having shoulder straps 80*a* and 80*b*. In this instance the front face 16 is zippered for access to the interior in which a portion includes the cell assembly 40. Exterior pouches 82*a*, 82*b* and 82*c* hold a variety of objects.

FIG. 9 illustrates one end of a travel bag in which the cell assembly 40 is shown collapsed at one end of the bag. The assembly may be stretched out for use and secured to the other end (not shown, but it is to the left in the figure) by snaps 38. The parts are numbered as in FIG. 1. A thin fabric liner 84 is conveniently used to cover the support tubes 30*a* and 30*b* extending along the back perimeter wall 24. It should be understood that the cell assembly may be completely unsnapped and removed from the interior. However, as shown in FIG. 9, it is stowed for future use, e.g., during travel, soiled or used clothing placed in the cells, with the assembly gradually expanding as it is filled up.

INDUSTRIAL APPLICABILITY

It is evident that the many features of the inventive dual access travel bag with its orthogonal cell assembly for isolation packing and side-wall mounted pop-up retractable handle, are particularly suited to wide use in the luggage industry. The inventive system is simple to manufacture, and instantly understandable as having high utility.

It should be understood that various modifications within the scope of this invention can be made by one of ordinary skill in the art without departing from the spirit thereof and without undue experimentation. This invention is therefore to be defined by the scope of the appended claims as broadly as the prior art will permit, and in view of the specification if need be, including a full range of current and future equivalents thereof.

Parts List
This Parts List is provided as an aid to examination;
it may be canceled upon Allowance

| | |
|---|---|
| A = | Longitudinal Adjustment |
| D = | Depth of Bag |
| H = | Height of Stowage Cells |
| 10 | Dual Face Access Luggage with Orthogonal Stowage Cells |
| 12 | Travel Bag |
| 14 | Top Face |
| 16 | Bottom Face |
| 18 a, b | Perimeter Zipper |
| 20 a, b | Pulls |
| 22 a, b | Pulls |
| 24 | Perimeter Wall |
| 26 | Handle Assembly |
| 28 | Handle |
| 30 a, b | Support Tubes |
| 32 | Wheels |
| 34 a, b | Legs |
| 36 a, b | Hand Grips |
| 38 a, b, c, d | Snaps |
| 40 | Stowage Cell Assembly |
| 41 | Cell Assembly Perimeter Wall |
| 42 a, b | Internal Zipper for Securing Stowage Cell Assembly |
| 44 a, b, c, d | Cells |
| 46 | Small Cells |
| 48 | Larger Cells |
| R = | Depth of Recess for Layered Packing |
| I-1, I-2 = | Direction of Insertion or Removed |
| 50 a, b, c | Article of Clothing (rolled) |
| 52 | External Pocket |
| 54 | Hygiene Kit (Shaving/Lav/Cosmetics) |
| 56 a, b, c | Layered Clothing |

-continued

| Parts List<br>This Parts List is provided as an aid to examination;<br>it may be canceled upon Allowance | |
|---|---|
| 58 | Draw Bar (plastic, wood, metal, etc.) |
| 59 | Magazine |
| 60 | D-Ring |
| 62 | Hook & Loop Strap (Velcro Brand) |
| 64 | Laptop Case |
| 66 | Laptop |
| 68 | Batteries |
| 70 | Floppies |
| 72 | Self-Stick Notepads (Post-It's) |
| 74 | Phone Cord |
| 76 | Space for Shoes |
| 78 a, b | Backpack |
| 80 a, b, c | Shoulder Straps |
| 82 a, b, c | Pockets |
| 84 | Liner |

What is claimed is:

1. An improved luggage bag having a perimeter side wall, a geuerally planar front face wall and a geuerally planar back face wall spaced therefrom by a full height dimension, said face walls and perimeter wall defining therebetween an interior packing volume having a dimension in a longitudinal direction, a dimension in a lateral direction, and said hight dimension defined between said face walls, the improvement comprising:

a) both said face walls are openable for selective access to the interior packing volume;

b) each of said face walls has a closure assembly to provide secure closure of said face wall;

c) a stowage cell assembly comprising an array of a plurality of adjoined cells made of stretch fabric material oriented so that said cell array has a variable size in both said longitudinal and said lateral direction depending on the stretch imparted thereto, and each said cell in said array has a height dimension equal to or less than the height dimension of said bag to provide a predetermined head space in said bag, each said cell having an axis parallel to said height dimension and spaced opposed ends that are openable upon stretching said fabric, said stretch fabric material stretches around and grippingly retains goods placed in said cells through either end thereof, said plurality of selectively accessible cells is secured in said interior packing volume of said bag oriented orthogonally to the plane of said faces for isolation packing and unpacking of goods; and d) said face walls and said stowage cell assembly are cooperatingly orthogonally oriented to permit, upon selectively opening either of both face walls, bi-directional access to said interior stowage cell assembly in order to introduce goods into said cells and to remove goods packed in said cells without disturbing goods in adjacent cells and goods in said head space on the side opposite the face wall selected for access.

2. An improved luggage bag as in claim 1 wherein said stowage cell assembly and said perimeter wall includes cooperating fastening devices for adjustment of said size to accommodate a varying number of goods or goods of varying dimensions.

3. An improved luggage bag as in claim 1 wherein at least some of said cells of said stowage cell assembly are formed of uni-axially stretchable material to permit said size adjustment.

4. An improved luggage bag as in claim 1 wherein said stowage cell assembly has a height less than said full height dimension.

5. An improved luggage bag as in claim 1 wherein at least some of said cells include closure assemblies.

6. An improved luggage bag as in claim 1 wherein at least some of said cells in said stowage cell assembly are larger than others to accommodate large objects.

7. An improved luggage bag as in claim 1 which includes wheels and a rolling transport handle.

8. An improved luggage bag as in claim 7 wherein said luggage bag is generally rectangular, said perimeter wall forms the perimeter of said rectangle, said handle is disposed in association with said perimeter side wall along a long dimension of said rectangle, said handle is telescoping, said wheels are located on one corner of said perimeter wall adjacent the intersection of said long dimension wall and an adjoining short dimension wall, and at least one fixed leveling leg is disposed spaced from said wheels on said short dimension wall.

9. An improved luggage bag as in claim 8, wherein at least one of said face wall closure assembly comprises a zipper assembly.

10. An improved luggage bag as in claim 1 wherein said bag is selected from a carry-on bag, a roll-on bag, a suitcase, a briefcase, a laptop computer case, a satchel-type bag, a back pack, a tote, or a specialty bag.

11. An improved luggage bag as in claim 1 wherein said stretch fabric is biaxially stretchable.

12. An improved luggage bag as in claim 1 wherein said stowage cell assembly includes fastener members that cooperate with fastener members secured to the interior of the bag peripheral wall for selectively removing or securing said assembly in place in the interior of said bag.

13. A goods stowage and transport bag having a plurality of sides and a depth defining an interior volume for receipt of goods for transport and at least one openable face having a closure mechanism to secure the goods stowed therein and an open cell stowage assembly of stretch material comprising walls and open opposed ends, said assembly is secured to the interior of said bag to grippingly retain goods placed in said cells and having a height less than the depth of said bag, the axis of the cells of said stowage assembly are disposed in said bag interior oriented generally orthogonal to said openable face for isolation packing of goods by introduction of goods into said cells and selective removal therefrom without disturbing the contents of adjacent cells.

14. A goods stowage and transport bag as in claim 13 which includes at least two openable faces each oriented to permit bi-directional access therethrough to said stowage cell assembly oriented orthogonally to each of said faces.

15. A goods stowage and transport bag as in claim 13 which includes wheels and a rolling transport handle.

16. A stowage assembly for travel and storage bags comprising an array of a plurality of connected stowage cells made of uni-axial stretch fabric material oriented so that said cell array has both a variable longitudinal extent and a variable lateral extent depending on the stretch imparted thereto, and each said cell in said array has a height dimension equal to or less than the depth of said bag to provide a predetermined head space in said bag, and each said cell in said array has spaced opposed ends that are openable upon stretching said fabric, said stretch fabric material stretches around and grippingly retains goods placed in said cells through either end thereof, and said stowage cell assembly includes at least one fastening device for removably securing said assembly in a preselected position in the interior packing volume of said bag for bi-directional access thereto from opposite sides of said bags and for orthogonal isolation packing of goods by introduction of goods into said cells and selective removal from opposite sides of said bags without disturbing the contents of adjacent cells or goods packed in said head space.

17. A stowage assembly for travel and storage bags as in claim 16 wherein said stowage cell assembly includes a peripheral wall member and said fastening device for securing said assembly in position on the interior of said bag includes a zipper or hook member that cooperatingly secures said array to a mating zipper or loop member on the interior wall of said bag.

18. A stowage assembly for travel and storage bags as in claim 16 wherein at least some of said cells in said stowage cell assembly are larger than others to accommodate large objects.

19. A stowage assembly for travel and storage bags as in claim 16 wherein said stowage cell assembly includes fasteners disposed on a periphery of said array so that said array is adjustable in size in said bag to accommodate a varying number of goods or goods of varying dimensions.

* * * * *